US009314690B2

(12) United States Patent
Kagen

(10) Patent No.: US 9,314,690 B2
(45) Date of Patent: Apr. 19, 2016

(54) GAME PLAYABLE IN MULTIPLE PHASES AND INCORPORATING COLLECTIBLES

(76) Inventor: Jonah C. Kagen, Pooler, GA (US)

( * ) Notice: Subject to any disclaimer, the term of this patent is extended or adjusted under 35 U.S.C. 154(b) by 921 days.

(21) Appl. No.: 13/079,976

(22) Filed: Apr. 5, 2011

(65) Prior Publication Data

US 2011/0248445 A1 Oct. 13, 2011

Related U.S. Application Data

(60) Provisional application No. 61/322,380, filed on Apr. 9, 2010.

(51) Int. Cl.

| | |
|---|---|
| ***A63F 3/00*** | (2006.01) |
| *A63F 1/04* | (2006.01) |
| *A63F 9/10* | (2006.01) |
| *A63F 9/18* | (2006.01) |

(52) U.S. Cl.

CPC ..... *A63F 3/00006* (2013.01); *A63F 3/00097* (2013.01); *A63F 1/04* (2013.01); *A63F 9/10* (2013.01); *A63F 9/18* (2013.01); *A63F 2003/00018* (2013.01); *A63F 2003/00353* (2013.01); *A63F 2003/00526* (2013.01); *A63F 2250/144* (2013.01)

(58) Field of Classification Search

CPC ..... A63F 3/0006; A63F 3/00097

USPC ..... 273/243, 284

See application file for complete search history.

(56) References Cited

U.S. PATENT DOCUMENTS

| | | | | |
|---|---|---|---|---|
| 3,874,671 | A * | 4/1975 | Smith | 273/254 |
| 5,338,041 | A * | 8/1994 | Jones et al. | 273/260 |
| 5,360,217 | A | 11/1994 | Taylor | |
| 5,443,269 | A | 8/1995 | Loritz | |
| 6,120,296 | A | 9/2000 | Lim | |
| 6,378,866 | B1 * | 4/2002 | Graham-Ward | 273/153 R |
| 7,316,607 | B2 | 1/2008 | Gauselmann | |
| 2004/0248644 | A1 * | 12/2004 | Seelig et al. | 463/20 |
| 2010/0120514 | A1 * | 5/2010 | Caputo | 463/22 |

* cited by examiner

*Primary Examiner* — Vishu Mendiratta
(74) *Attorney, Agent, or Firm* — Nixon & Vanderhye P.C.

(57) ABSTRACT

A game is playable in two phases. In a first phase, a player is required to perform certain tasks, after which the player earns a collectible item. In a second phase, the player uses the earned collectible item to play a board game. The first phase may include multiple stages, and the game may be constructed such that a game piece is awarded for completing each stage. Alternatively, the collectible item may be awarded only after completing the last stage. Certain tasks may comprise at least one of solving problems, achieving certain goals, answering questions, solving puzzles, etc.

9 Claims, 1 Drawing Sheet

PHASE 1

PHASE 1

PHASE 2

GAME PLAYABLE IN MULTIPLE PHASES AND INCORPORATING COLLECTIBLES

CROSS-REFERENCES TO RELATED APPLICATIONS

This application claims the benefit of U.S. Provisional Patent Application Ser. No. 61/322,380, filed Apr. 9, 2010, the entire content of which is herein incorporated by reference.

STATEMENT REGARDING FEDERALLY SPONSORED RESEARCH OR DEVELOPMENT (NOT APPLICABLE)

BACKGROUND OF THE INVENTION

Board games typically have a theme on which the game is premised. Players play against one another to achieve a common goal, such as reaching a certain location, collecting/earning money, discovering a hidden component, etc. Successful board games keep player interest over time.

A recent trend has games using collectible items such as trading cards and/or game pieces during game play. The collectible items may be produced in smaller quantities to increase desirability, but the items are typically purchased as part of a game or as part of a separately purchasable game pack or the like.

BRIEF SUMMARY OF THE INVENTION

In an exemplary embodiment, a game is playable in two phases. In a first phase, a player is required to perform certain tasks, after which the player earns a collectible item. In a second phase, the player uses the earned collectible item to play a board game. The first phase may include multiple stages, and the game may be constructed such that a game piece is awarded for completing each stage. Alternatively, the collectible item may be awarded only after completing the last stage. Certain tasks may comprise at least one of solving problems, achieving certain goals, answering questions, and solving puzzles.

In another exemplary embodiment, a method of playing a game, which includes a collectible item trapped in a game apparatus, comprises the steps of (a) playing a first game phase by performing certain tasks with the game apparatus to earn the collectible item; and (b) playing a second game phase utilizing the collectible item. Step (b) may be practiced by playing a board game using the collectible item. In one embodiment, step (a) is practiced by a single player, and step (b) is practiced with other players.

In yet another exemplary embodiment, a game playable in two phases includes a game housing including a collectible item trapped therein, and a game board separate and independent from the game housing. In a first phase, a player is required to perform certain tasks, after which the collectible item is released from the game housing. In a second phase, the player uses the released collectible item to play a board game on the game board. Preferably, the game housing is configured such that the collectible item is visible during the first phase. In this context, the first phase may comprise multiple stages, where the player is required to complete each of the multiple stages in order to release the collectible item. Preferably, the game housing is configured to displace the collectible item closer to an exit upon the player completing each of the multiple stages.

BRIEF DESCRIPTION OF THE DRAWINGS

These and other aspects and advantages of the invention will be described in detail with reference to the accompanying drawings, in which.

DETAILED DESCRIPTION OF THE INVENTION

Figure 1:
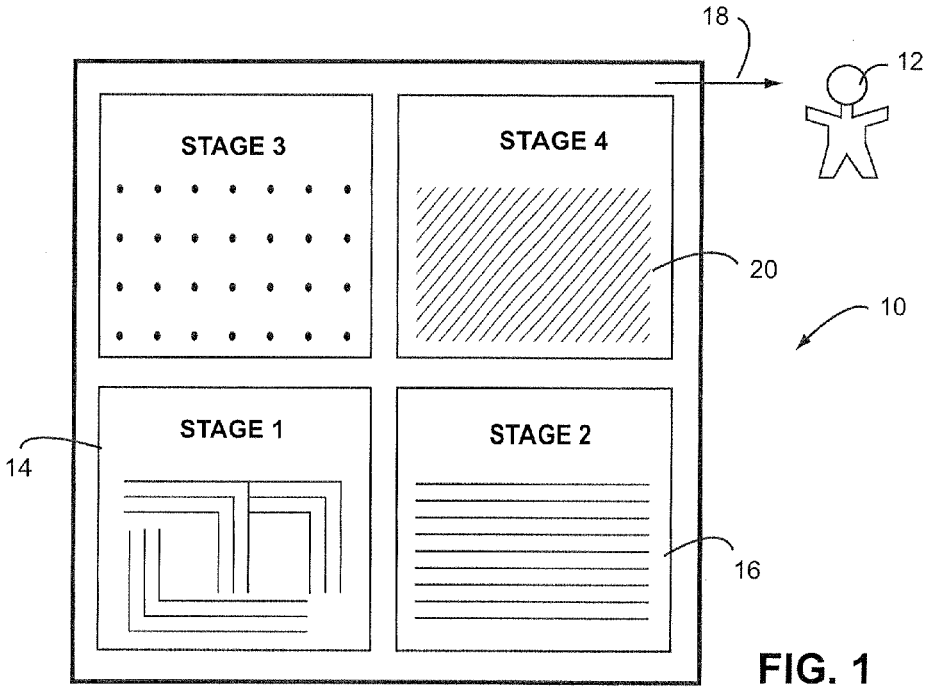
FIG. 1 is a schematic overview of the game concept first phase according to the invention.

The invention embodies a game that is played in at least two phases. A schematic representation of the first phase is shown in FIG. 1. Consumers/players purchase a game unit or game housing 10. The game unit incorporates one or more collectibles 12, preferably known to the purchaser. The collectibles, however, are not readily accessible. In a first phase of the game, the player must complete certain tasks, such as solve puzzles 14, answer questions 16, etc. As the player plays the game, each correct move, answer, etc. gets the player closer to releasing the collectible item 12. It is preferable that the player sees the collectible 12 in the game unit 10, and the collectible 12 is displaced toward an exit 18 or the like as the player makes progress through the game.

When the first phase of the game is complete, e.g., the puzzle is solved, the collectible 12 is made accessible to the player. For example, the game unit may displace the collectible 12 to an access port, or the game unit may expel the collectible from the unit or some other means may be included to signify successful completion of the first phase. The first phase of the game may include multiple stages 14, 16 where a collectible game piece (or game piece in general) 12 may be earned at the completion of each stage. In this embodiment, the game may be configured such that only the last stage 20 awards a collectible game piece 12, while earlier stages award more common game pieces.

Any suitable structure may be used for securing the collectible 12 until the first phase of the game is complete. In an exemplary construction, the collectible 12 is held under a spring load against a locked door or panel. Upon completion of one or more stages in the first phase, the locked door or panel is opened, and the collectible 12 can be displaced by the spring load either out of the game housing 10 or into the next game stage. Other structures will be apparent to those of ordinary skill in the art, and the invention is not meant to be limited to a specific mechanism.

Figure 2:
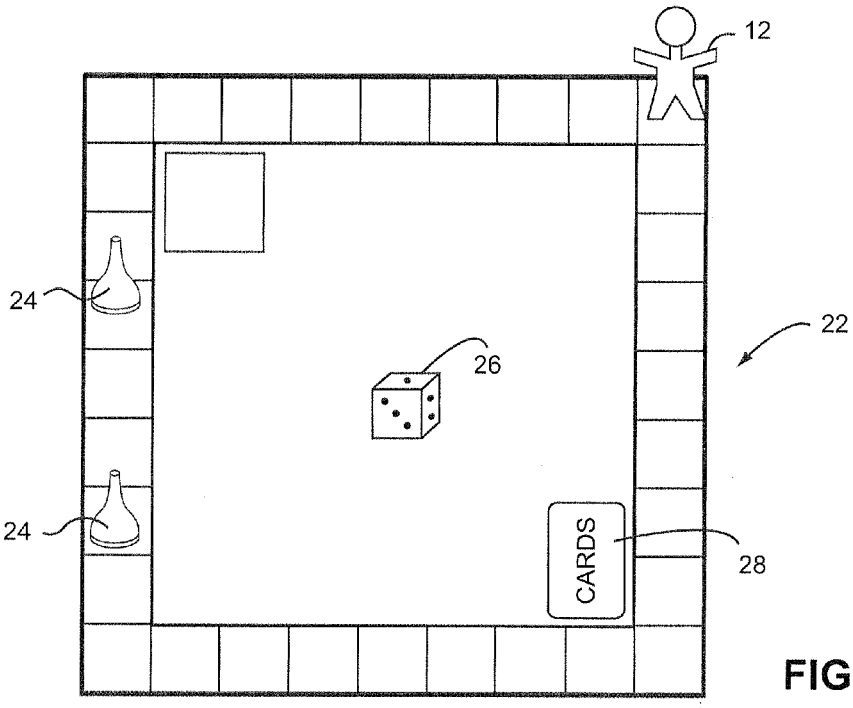
FIG. 2 is an exemplary application of the game concept second phase.

With reference to FIG. 2, in a second phase of the game, after the first phase has been completed, the player uses the earned collectible 12 as a playing piece in a more conventional game 22, such as a board game or the like. For the second phase, additional game pieces may be provided, including dice 26, game cards 28, non-collectible playing pieces 24, etc. The game board is preferably included with the purchase of the game unit and is suited for game play using the retrieved collectible 12.

It is desirable to link the game phases with a common theme. Also, game difficulty can be varied depending on the intended age range. The game may be designed such that the first phase could take days, weeks or months to complete. Difficulty may also be increased depending on the rarity of the collectible, which may or may not be selected by the purchaser.

The game may also be embodied in an electronic format, where the collectible item is a virtual collectible or a graphical representation. The game can be played online, using existing game platforms, or with a self-contained unit.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A method of playing a game including a game board and a collectible item trapped in a game apparatus, the method comprising:

(a) playing a first game phase without the game board by performing certain tasks with the game apparatus to earn and retrieve the collectible item; and (b) playing a second game phase with the game board utilizing the collectible item.

2. A method according to claim 1, wherein step (a) is practiced by a single player, and wherein step (b) is practiced with other players.

3. A method according to claim 1, wherein the certain tasks comprise at least one of solving problems, achieving certain goals, answering questions, and solving puzzles.

4. A game playable in two phases, comprising:

a game housing including a collectible item trapped therein, wherein in a first phase, a player is required to perform certain tasks, after which the collectible item is released from the game housing; and a game board separate and independent from the game housing, wherein in a second phase, the player uses the released collectible item to play a board game on the game board such that the released collectible item is structurally cooperable and correlated with the game board.

5. A game according to claim 4, wherein the certain tasks comprise at least one of solving problems, achieving certain goals, answering questions, and solving puzzles.

6. A game according to claim 4, wherein the game housing is configured such that the collectible item is visible during the first phase.

7. A game according to claim 6, wherein the game housing is configured to displace the collectible item closer to an exit as the player gets closer to completing the first phase.

8. A game according to claim 6, wherein the first phase comprises multiple stages by multiple sections in the game housing, and wherein the player is required to complete each of the multiple stages in order to release the collectible item.

9. A game according to claim 8, wherein the game housing is configured to displace the collectible item closer to an exit upon the player completing each of the multiple stages.

* * * * *